US005620207A

United States Patent [19]

Podosek et al.

[11] Patent Number: 5,620,207

[45] Date of Patent: Apr. 15, 1997

[54] RING BINDER COVER

[75] Inventors: Edward Podosek, Wilbraham; Vytautas K. Beleckis, East Longmeadow, both of Mass.

[73] Assignee: Avery Dennison Corporation, Pasadena, Calif.

[21] Appl. No.: 325,228

[22] PCT Filed: Apr. 21, 1993

[86] PCT No.: PCT/US93/03786

§ 371 Date: Dec. 22, 1994

§ 102(e) Date: Dec. 22, 1994

[87] PCT Pub. No.: WO93/21021

PCT Pub. Date: Oct. 28, 1993

[51] Int. Cl.[6] ..... B42C 7/00; B42F 13/00

[52] U.S. Cl. ..... 281/29; 402/73; 402/502

[58] Field of Search ..... 281/29; 402/73–77, 402/502; 412/3, 17

[56] References Cited

U.S. PATENT DOCUMENTS

| | | | |
|---|---|---|---|
| 2,486,330 | 10/1949 | Schade | 281/29 |
| 3,190,678 | 6/1965 | Peterson et al. | 281/29 |
| 3,195,924 | 7/1965 | Carter et al. | 281/29 |
| 3,228,709 | 1/1966 | Tooker | 281/29 |
| 3,318,618 | 5/1967 | Mullen et al. | 281/29 |
| 3,572,957 | 3/1971 | Strassberg | 281/29 X |
| 4,138,143 | 2/1979 | Lawes | 281/29 X |
| 4,583,877 | 4/1986 | Wilson | 281/29 X |
| 4,795,194 | 1/1989 | Etheredge | 281/31 X |
| 4,856,817 | 8/1989 | Moor | 281/29 |
| 5,213,368 | 5/1993 | Wyant | 281/29 X |
| 5,222,825 | 6/1993 | Wyant . | |

FOREIGN PATENT DOCUMENTS

| | | | |
|---|---|---|---|
| 739638 | 11/1955 | United Kingdom | 281/29 |
| 1123779 | 8/1968 | United Kingdom | 281/29 |

*Primary Examiner*—Frances Han

*Attorney, Agent, or Firm*—Kriegsman & Kriegsman

[57] ABSTRACT

A ring binder cover (4) is composed of a pair of themoplastic sheets (20, 22) superimposed in edge-to-edge relation with a stiffener insert panel (23) disposed therebetween. The insert panel bears two parallel grooves (25, 27) which divide the insert into a spine zone (30) and two cover zones (24, 26). The material of the insert lying at the bottom of the grooves forms a pair of flexible strips (32, 34) which, combined with the adjacent portions of the cover sheets, form hinges between the spine and each cover. The peripheral edge portions (40) of the two thermoplastic sheets are sealed together and provide a sealed envelope for the stiffener insert which defines semi-rigid back and front cover panels of the binder, hingedly connected to a rigid spine. The insert can be provided with insert notches (370, 470, 570) at each end of each flexible strip to reduce outward protuberance of the peripheral edge at the hinge ends. At the mouth of each insert notch, the peripheral edge can carry straight across, or can follow inward toward the insert notch to form a seam notch, or can have a seam area which extends inward toward each insert notch. Another feature which can be incorporated into the ring binder concept of this invention is the idea of a curvable spine. The curvable spine idea involves providing one or more hinge-like spine grooves (641, 642, 643, 644) on the inside surface of the spine portion of the insert between the two hinge grooves. This allows the spine to flatten when the covers are open, but to curve about the longitudinal axis of the spine (concave on the inside and convex on the outside) when the covers are closed.

10 Claims, 13 Drawing Sheets

RING BINDER COVER

FIELD OF THE INVENTION

This invention relates to ring binders intended to hold sheets of material.

BACKGROUND OF THE INVENTION

For many years it has been the practice in the manufacture of ring binders to fabricate the cover for such binders in a three-ply construction. Three rigid or semirigid, rectangular inserts or stiffener panels are heat-sealed between two superimposed sheets of thermoplastic material. Of the three stiffener panels generally used, two of them approximate in size, the back and front panels of the binder. The third panel is a narrower insert strip disposed between the two larger panel to form the back panel or spine of the binder. The inner and outer plastic sheets are fused together or heat-sealed around their peripheral edges. The sheets are also sealed transversely between the adjacent, transverse edges of the cover panel inserts and the back panel inserts. The transverse seals form the hinge areas of the binder. U.S. Pat. No. 3,195,924 is typical of this type of binder construction.

There are several significant disadvantages in a conventional heat-sealed binder cover, particularly along the hinge portions where the cover and the spine or backbone of the binder intersect. Along the hinge lines, the outer plastic sheets are fused or heat-sealed together and their composite thickness is substantially less than the total thickness of the two sheets before the heat-sealing operation. For example: where the two outer sheets of thermoplastic are each 0,015 inch vinyl, the composite thickness, when fused together, is only about 0,020 inch or about 30% less than the total of 0,030 inch where there has been no heat sealing of the plastic sheets. This thickness reduction significantly reduces tensile strength.

In addition, during heat-sealing, the more volatile plasticizers in the vinyl sheet materials are volatilized "off" and the hinge lines tend to be more brittle than the unfused vinyl. This reduces resistance to cracking failure. Moreover, during the heat-sealing operation, the vinyl films along the hinge lines are invariably stretched over the edges of the chipboard inserts when drawn together for sealing so that the plastic sheet material in these areas becomes thinner (thickness reduction to 33% to 50% are typical) than the unsealed vinyl and thus more susceptible to material fatigue failure.

Still another practical problem caused by the shortcomings of the abovedescribed prior art construction might be called spine intrusion. This problem occurs when the binder, filled with pages, is sitting in a vertical position (with the spine vertical) for a long period of time. More specifically, the loose leaf mechanism of the binder is riveted to the spine and loaded with paper. The binder is then placed on a shelf in a vertical position, as normally seen in a book case. The weight of the paper on the top ring rotates the spine inward or forward until the bottom front corner of the edges of the paper comes to rest on the storage shelf. This stress on the spine and hinges causes the spine-edge of the covers to spread outward and the upper part of the spine to move inward between the covers. This happens over a period of time, which varies depending upon the weakness of the hinge, and the weight of the paper. The end result is that usually the upper one third of the spine is bent inward and the outside of the top of the spine is either flush with, or inside the upper edges of the front and back covers of the loose leaf binder. This effect detracts from the appearance of the binder. More importantly, this pulling stress on the hinges frequently causes the hinges to tear, thus damaging the binder. These and other difficulties experienced with the prior an devices have been obviated in a novel manner by the present invention.

The principal object of this invention is to provide an improved ring binder construction and method of fabricating the same which overcome the drawbacks of the prior art construction.

Another object of this invention is to provide an improved ring binder cover having a spine and hinge construction of remarkably enhanced durability without sacrifice in either the appearance or functionality of the binder.

A still further object of this invention is the provision of a plastic-sealed binder which has the appearance of the more expensive case-bound-type binder.

With these and other objects in view, as will be apparent to those skilled in the art, the invention resides in the combination of parts set forth in the specification and covered by the claim appended hereto.

SUMMARY OF THE INVENTION

A ring binder cover is composed of a pair of thermoplastic sheets superimposed in edge-to-edge relation with a stiffener inert panel disposed therebetween. The insert panel bears two parallel grooves which divide the insert into a spine zone and two cover zones. The material of the insert lying at the bottom of the grooves forms a pair of webs which, combined with the adjacent portions of the cover sheets, form hinges between the spine and each cover. The peripheral edge portions of the two thermoplastic sheets are sealed together and provide a sealed envelope for the stiffener insert which defines semi-rigid back and front cover panels of the binder, hingedly connected to a rigid spine.

The insert can be provided with insert notches at each end of each web to reduce outward protuberance of the peripheral edge at the hinge ends. At the mouth of each insert notch, the peripheral edge can carry straight across, or can follow inward toward the insert notch to fore a seam notch, or can have a seam web which extends inward toward each inert notch.

Another feature which can be incorporated into the ring binder concept of this invention is the idea of a curvable spine. The curvable spine idea involves providing one or more hinge-like spine grooves on the inside surface of the spine portion of the insert between the two hinge grooves. This allows the spine to flatten when the covers are open, but to curve about the longitudinal axis of the spine (concave on the inside and convex on the outside) when the covers are closed.

BRIEF DESCRIPTIONS OF THE DRAWINGS

The above and other objects and advantages of this invention will be more readily apparent from a reading of the following description taken in conjunction with the following drawings in which:

FIG. 1 is a perspective view of a ring binder of the type embodying this invention, FIG. 2 is a sectional elevational view on an enlarged scale showing a portion of the binder of FIG. 1, FIG. 3 is an exploded perspective view showing the components of which the ring binder embodying this invention is composed, FIG. 4 is a diagrammatic elevation view of the hinge action embodied in the present invention, FIG. 5 is a diagrammatic elevation view of a prior art plastic hinge action, FIG. 6 is a diagrammatic view of the device shown in FIG. 4, but with the covers closed, FIG. 7 is a diagrammatic view of the prior art device shown in FIG. 5, but with the covers closed, FIG. 8 is a diagrammatic sectional view of an insert with unitary hinges, FIG. 9 is a diagrammatic sectional view of an insert with a full-face hinge layer, FIG. 10 is a diagrammatic sectional view of an insert with a separately-tapered hinge, FIG. 11 is a cross-sectional view of the peripheral seal of the prior art, FIG. 12 is a cross-sectional view of the peripheral seal which can be incorporated in the present invention, FIG. 13 is an elevation view of the outside spine of a binder, with covers closed, showing protuberances at the upper hinge ends, FIG. 14 is an elevation view of the outside spine of an embodiment of the present invention, with covers closed in which the protuberances shown in FIG. 13 are eliminated, FIG. 15 is an elevation view, with partial cut-away, of the outside spine of art embodiment of the present invention, with covers open, and showing an insert notch and a seam notch, FIG. 16 is a sectional view taken along line XVI—XVI of FIG. 15, FIG. 17 is a sectional view taken along line XVII—XVII of FIG. 18, FIG. 18 is an elevation view, with partial cut-away, of the outside spine of an embodiment of the present invention, with covers open, and showing an insert notch and notchless seam, FIG. 19 is a sectional view taken along line XIX—XIX of FIG. 20, FIG. 20 is an elevational view, with partial cut-away, of the outside spine of an embodiment of the present invention, with cover open, and showing an insert notch and seam web, FIG. 21 is a perspective view of a ring binder of the type embodying the curvable-spine concept of this invention, FIG. 22 is a sectional elevational view on an enlarged scale showing a portion of the binder of FIG. 21, in its open position, FIG. 23 is an exploded perspective view showing the components of which the ring binder embodying the curvable-spine concept of this invention is composed, FIG. 24 is a sectional elevational view on an enlarged scale showing a portion of the binder of FIG. 21, in its closed position, FIG. 25 is a diagrammatic view of the open position of a hinge in a flat spine embodiment, FIG. 26 is a diagrammatic view of the closed position of a hinge in a flat spine embodiment, FIG. 27 is a diagrammatic view of the open position of a hinge in a curvable-spine embodiment, and FIG. 28 is a diagrammatic view of the closed position of a hinge in a curvable-spine embodiment.

DESCRIPTION OF THE PREFERRED EMBODIMENT

Figure 1:
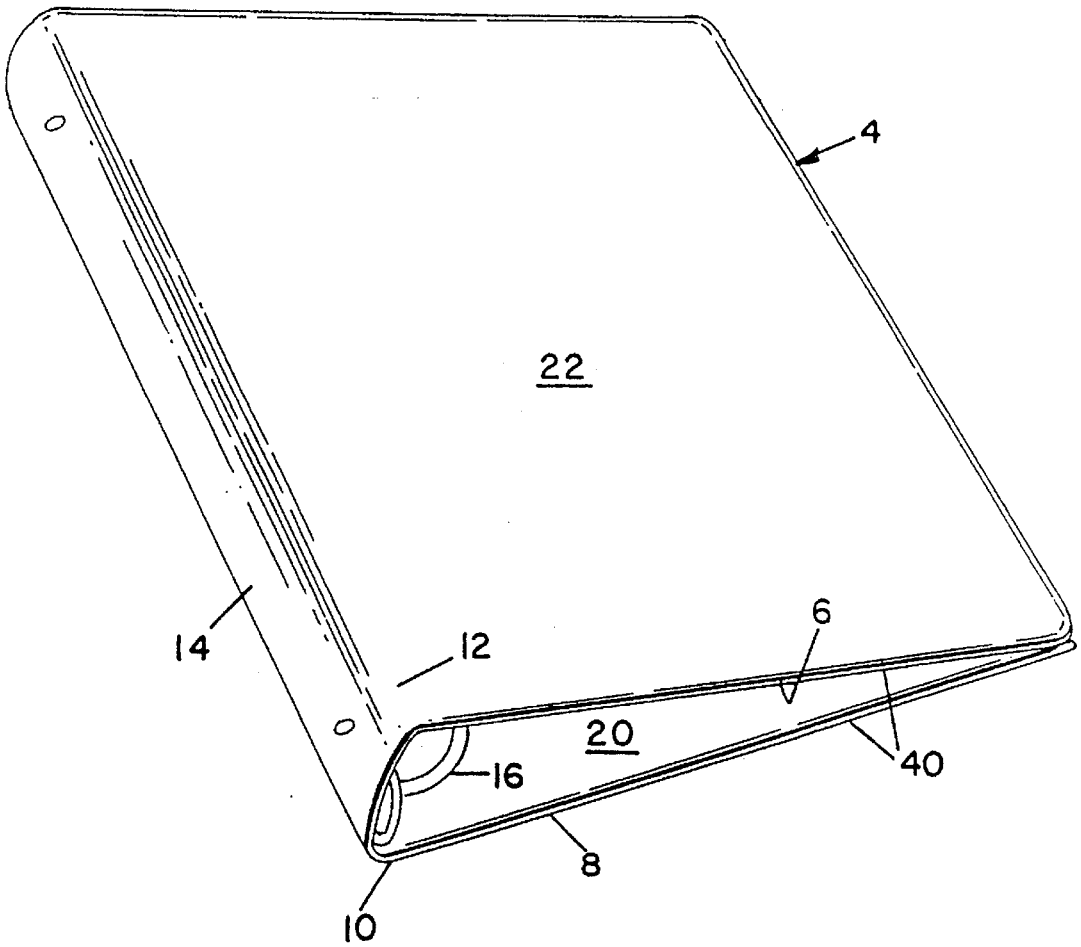

Referring in detail to the drawings, FIG. 1 shows a ring binder 4 of the type embodying this invention. The ring binder includes from and back cover panels 6 and 8, respectively. The two cover panels are hinged along transverse hinge lines 10 and 12 to a back panel or the spine portion of the binder, as indicated generally 14. A conventional ring binder mechanism 16 is affixed to the inner surface of the binder along its backbone portion.

The binder is composed of two rectangular sheets or films 20 and 22 of a synthetic plastic material which is preferably a thermoplastic heat-sealable or fusible material, such as an ethyl-vinyl-acetate polymer, a poly-vinyl-chloride polymer, or a polyolefin. The polymer sheets 20 and 22 are of sufficient overall size to form the entire inner and outer surface covering of the binder. These sheets may be of any desirable surface texture and may be of any suitable color to give the binder its desired appearance.

Figure 2:
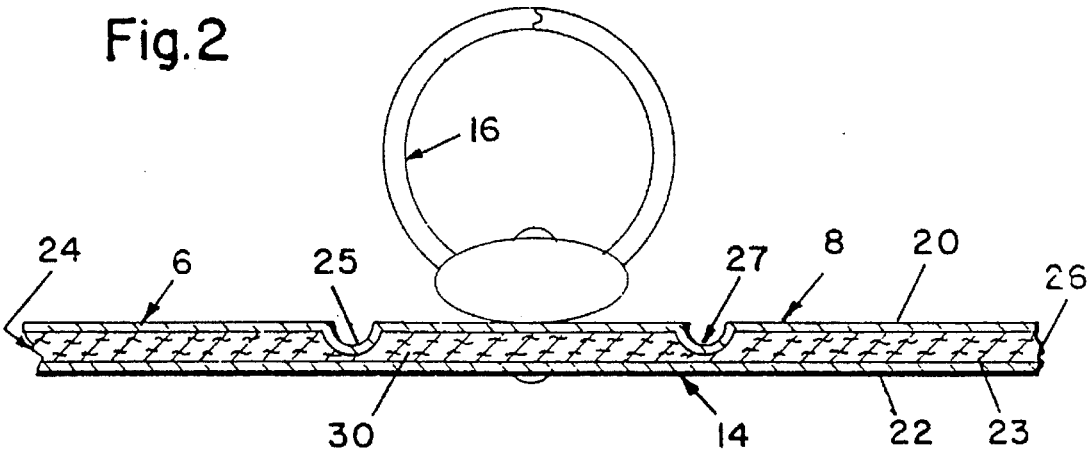
Figure 3:
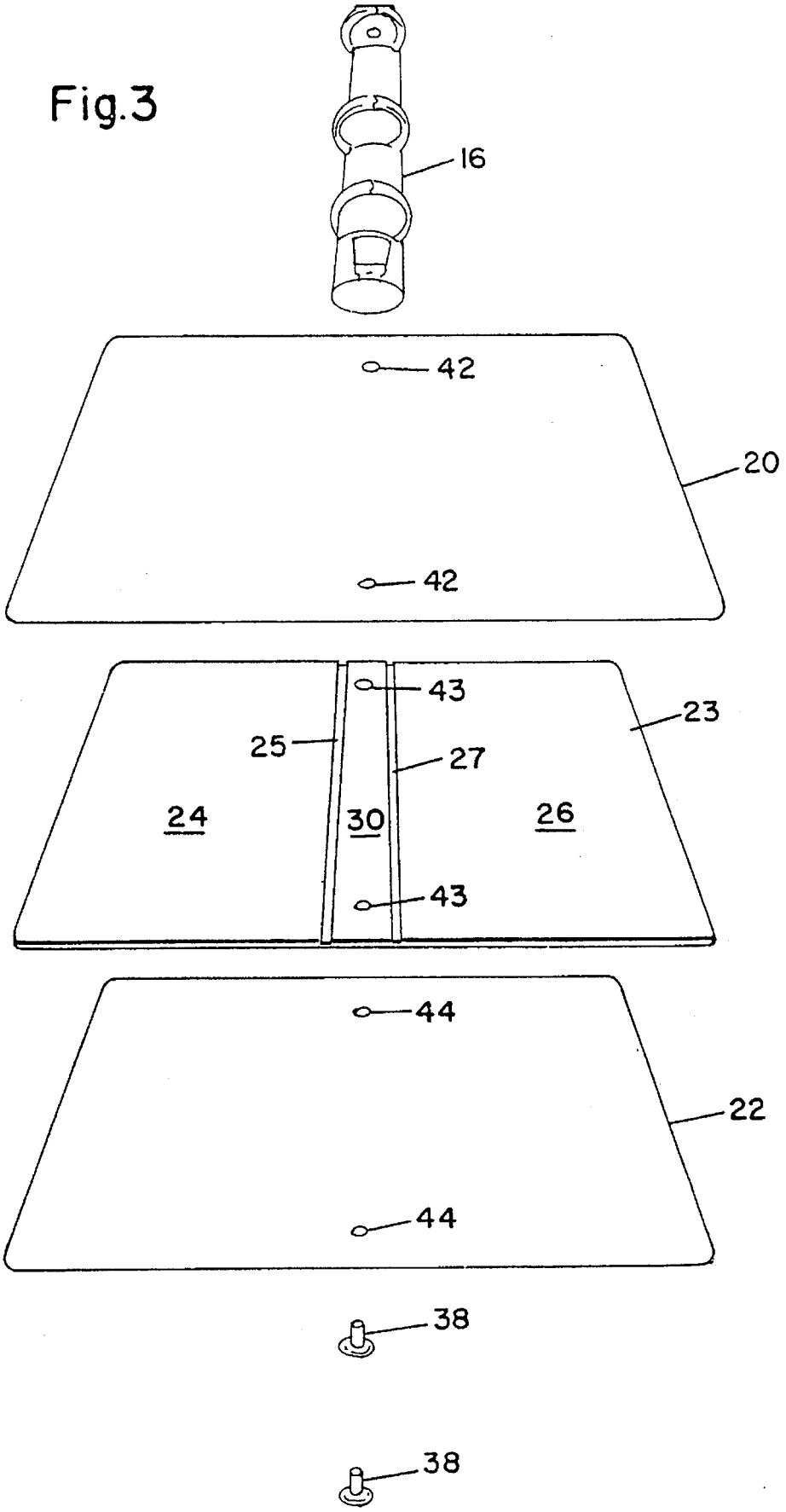

Referring to FIGS. 2 and 3, disposed between thermoplastic sheets, is a semirigid or form stable, rectangular insert 23. The insert 23 is formed or machined with two parallel grooves 25 and 27 which divide the insert into three zones. Zones 24 and 26 are dimensioned to be approximately the same length and width as the cover panels of the binder. Zone 30 is dimensioned to be approximately the same length and width as the spine 14. The insert may be made of any suitable stiffening material, such as clipboard or fiberboard. The stiffening material and, the depth of the grooves 25 and 27 are selected so that the grooves form stable but flexible hinges.

In fabricating the binder, the cover insert 23, made up of zones 24, 30, and 26, are disposed between the two sheets of the vinyl polymer sheet material 20 and 22 and only the peripheral edges 40 (FIG. 1) of the vinyl sheets are sealed together. In this manner, a large sealed pocket or envelope is formed which encapsulates the insert. It will be noted that no transverse sealing of the vinyl sheets to each other, is carried out in the area of the binder backbone at or between the hinges 25 and 27 of the cover insert 23. Thus, as best illustrated in FIG.. 2, the thermoplastic sheets or films remain entirely separated from each other (except, of course, at the ends of each hinge) and unfused to each other (except at the hinge ends) in the hinge areas of the binder cover.

Because the space between the sheets 20 and 22 is evacuated, the sheet 20 is drawn into the grooves 25 and 27 so to form an attractive hinge inner surfaces. Adhesive between the insert 23 and the sheets 20 and 22 bonds the sheets 20 and 22 to the insert 23 and especially to the webs 32 and 34, to keep the fabricated structure stable and to cause the insert 23 and sheets 20 and 22 to cooperate in making the hinges very strong.

The spine zone 30 includes a pair of upstanding posts, studs or rivets 38 which are longitudinally spaced apart to fit through correspondingly spaced holes 42, 43 and 44 provided through the vinyl sheets and insert, along the centerline thereof. By peening over their inner ends, the rivets serve to fasten the base plate of the binder mechanism 16 securely against the inner surface of the sheet 20.

The hinges 10 and 12 of the binder are formed by the strong material remaining at the bottom of each groove 25 and 27. With this construction, there is no thermal sealing or fusion of the thermoplastic sheet material in the hinge areas. The sheets will thus retain their inherent tear strength and pliability and remain highly resistant to embrittlement and material fatigue in contrast to such tendencies in similar types of binders which heat seal in the hinge area.

This construction thus has all the advantages of the conventional three-ply binder construction with stiffening inserts sealed between thermoplastic sheets, but does not suffer the drawbacks of these prior binder constructions because the hinges are formed of the unit insert material.

Figure 4:
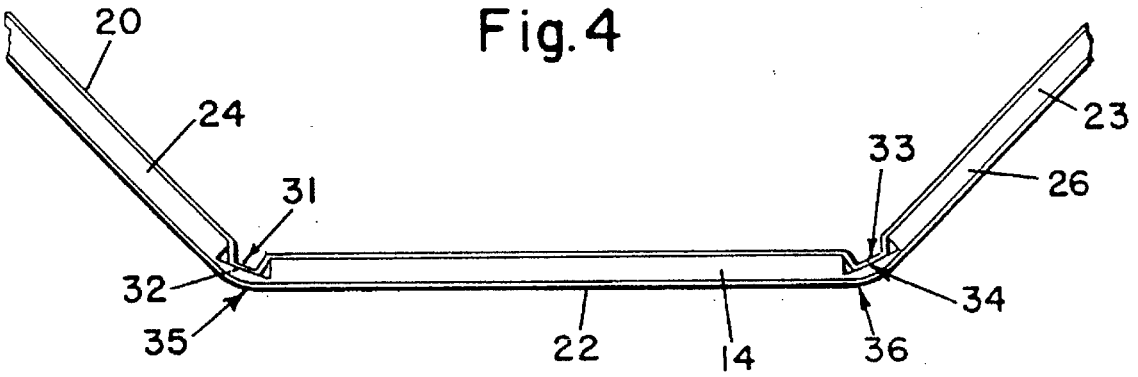
Figure 5:
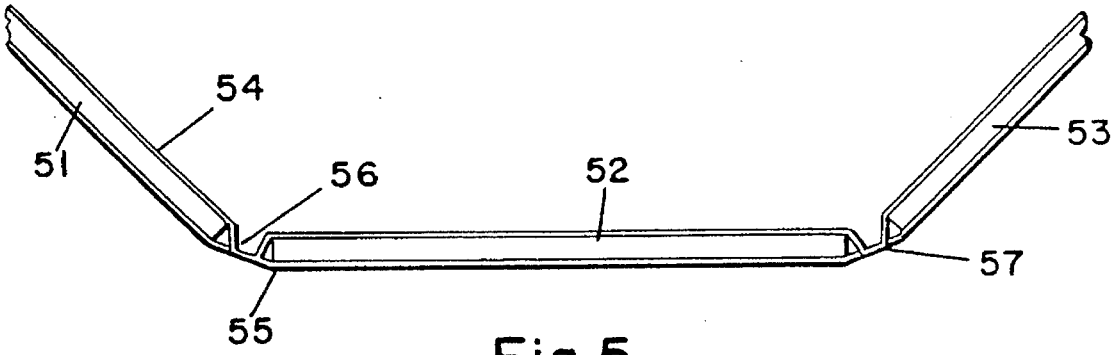
Figure 6:
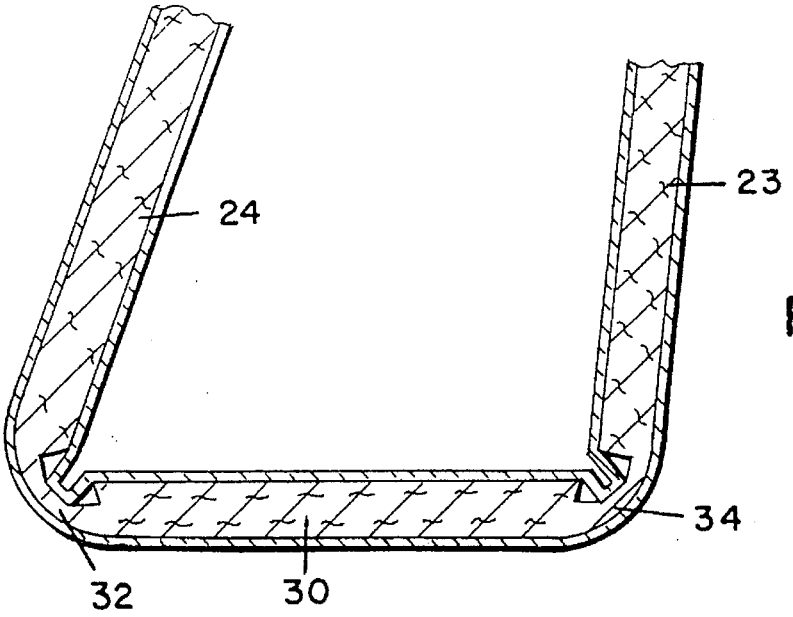
Figure 7:
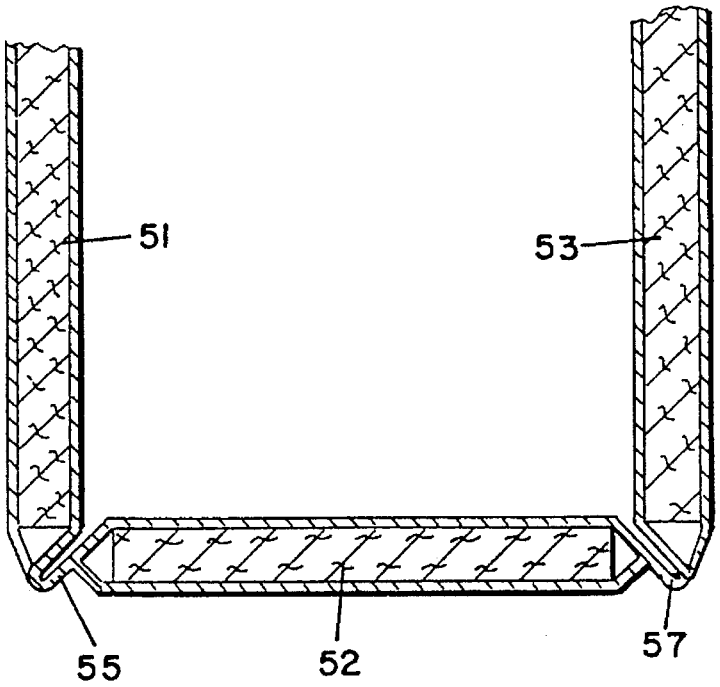

The manner which the hinges of the present invention function to eliminate spine intrusion is best shown in FIGS. 4 and 6. FIG. 4 shows the binder starting to close. Each flexible web 32 and 34 is shown adhesively bound to adjacent portions 31 and 33 of the inner sheet 20, and adjacent portions 35 and 36 in the outer sheet 22. The adjacent portions are not thermally treated and therefore retain their full thickness, strength and failure resistance. FIG. 6 shows that the stability of the hinge prevents spreading of the front and back cover and thereby prevents the binder contents from pulling the spine inward. FIGS. 5 and 7 show the prior art hinge structure, which, as shown in FIG. 7, allows the covers to spread and the spine to be drawn inward. The Separate insert pieces 51, 52 and 53 are each surrounded by the inner sheet 54 and outer sheet 55. The sheets are heat-sealed between the zones to form hinges 56 and 57.

Figure 8:
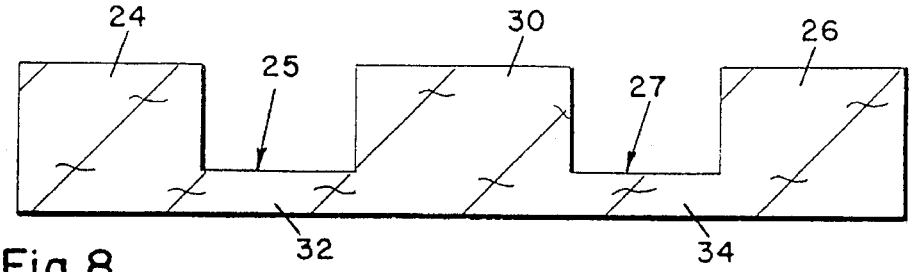
Figure 9:
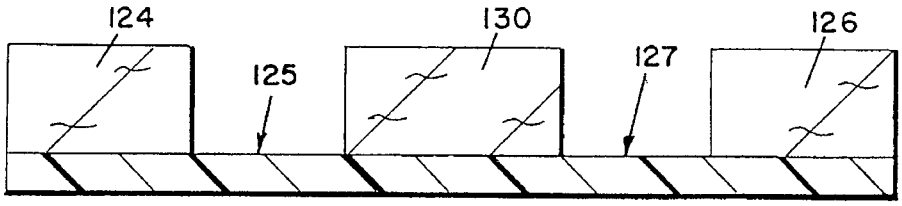
Figure 10:
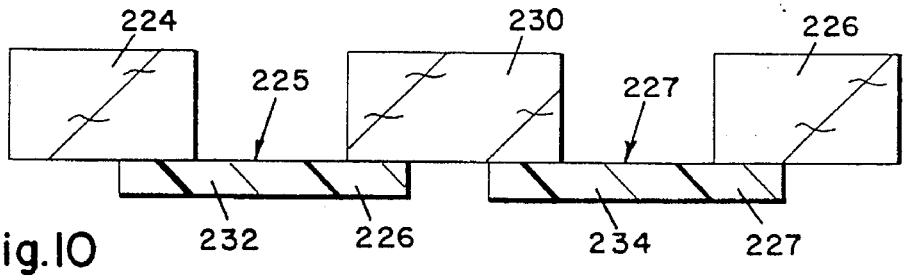

The unitary hinged insert of the present invention may be formed in many ways. In each case, the hinges are formed by flexible webs which connect the three insert zones together. FIG. 8 shows a diagrammatic sectional view of the preferred method in which a sheet of fiber board is milled with two grooves, preferably rectangular in cross-section. The webs 32 and 34 which remain after the milling act as strong hinges. In FIG. 9, a variation is shown in which three separate boards are glued to a flexible backing 126 which acts as the hinge. FIG. 10 shows a variation in which the hinges are formed between three separate plates 224, 225, and 226 using flexible tapes 226 and 227.

Figure 11:
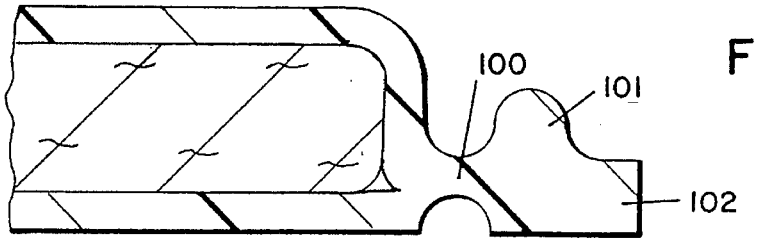
Figure 12:
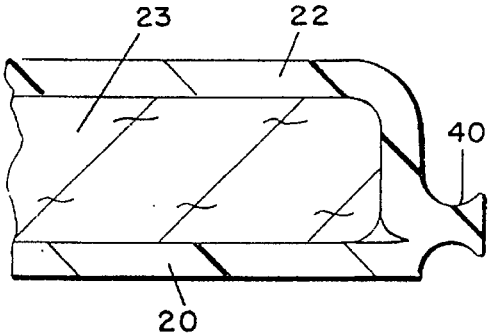

The binders which are formed by employing the principles of the present invention have a hinge construction which give the exterior of the spine of the binder the look of a more expensive, case-bound product. This look of quality can be enhanced by sealing the peripheral edges 40 with a geometry which carries the casebound look to the entire exterior of the binder. More specifically, as shown in cross-section in FIG. 11, the conventional peripheral seal has a cross-section which includes an inner sealed construction 100, a bead 101 exterior to the inner constriction, and then an outer seam 102. By eliminating the bead and outer seam, and thereby leaving only a single minimal seal, as shown in cross-section in FIG. 12, a case-bound look can be achieved.

Figure 13:
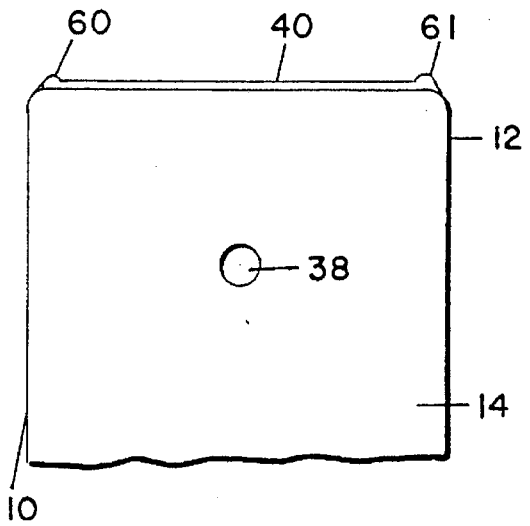

The above-described ring binder construction has an aspect which can be undesirable. FIG. 13 shows a view of the outside of the spine, with the binder covers closed. At each end of the hinges 10 and 12, the peripheral seam 40 tends to compress outward of the end of each hinge 10 and 12 to form protuberances 60 and These protuberances are neither large or unsightly. However, they can form points of premature friction-induced wear and seam splitting if the binder is frequently slid across an abrasive shelf or other surface.

Figure 14:
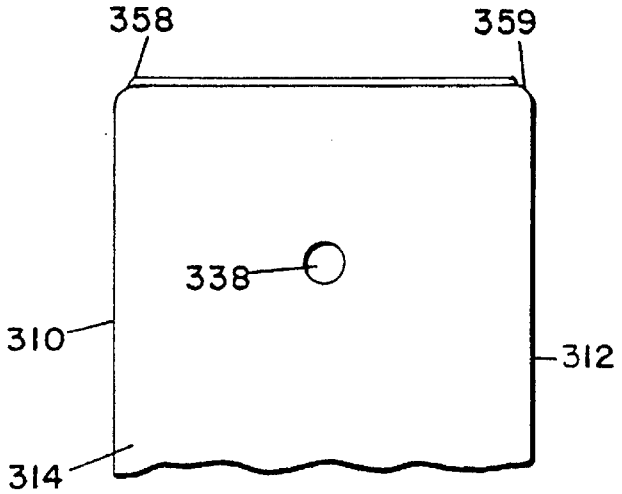
Figure 15:
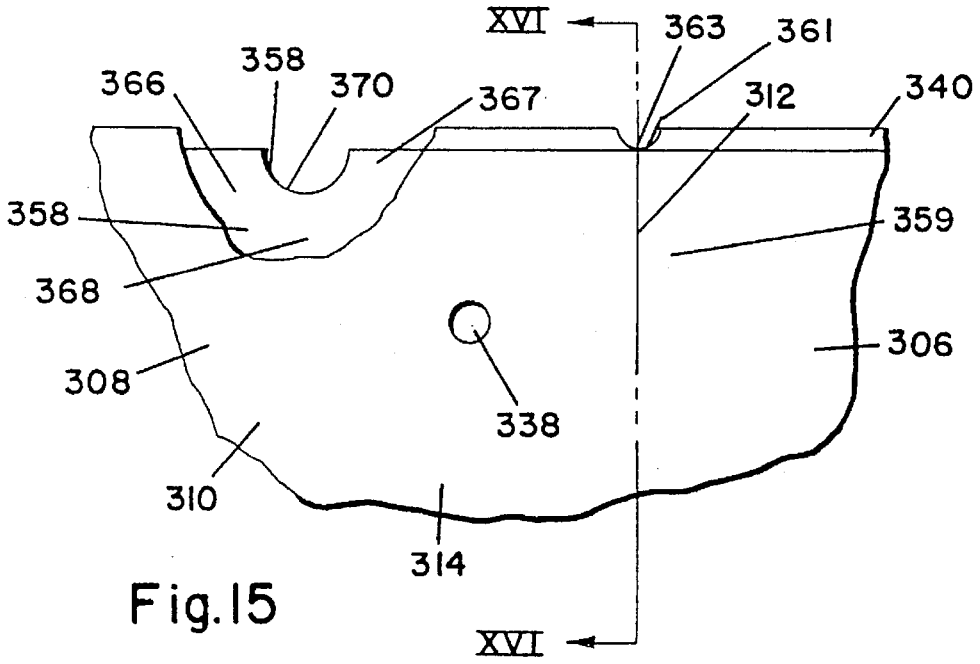

It is desirable to eliminate the protuberances 60 and 61 so that the binder takes the form shown in FIG. 14. In that embodiment, the spine 314, with rivet 338, is shown without protuberances at the ends 358 and 359 of hinges 310 and 312. The bottom of the spine would also be free of protuberances. This is accomplished as shown in FIG. 15, which is a view of the spine 314 with the front and rear covers 308 and 306 open. It should be understood that FIG. 15 shows the top end of the spine 314, while a mirror image of FIG. 15 exists at the bottom end of the spine 314. At each hinge end 358 and 359 (and similarly end 360 and 361 at the bottom of the hinges), seam notches or seam semi-circles 362 (not shown), 363, 364 (outside of view), and 365 (outside of view) are cut out of the seam 340 area. The seam 340 is formed on and follows the periphery of each of the seam notches. In the preferred embodiment of this concept, the hinge ends 358 and 359 (and 360, and 361 at the bottom of the spine) of the hinge web 368 and 369 (not visible) of the insert 367 are also cut out to form insert notches or insert semi-circles 370 (shown in cut-away 366), 371 (not visible in figure), 372 (outside of figure), and 373 (outside of figure). When the binder is closed, the seam notches 362, 363, 364, and 365, reduce the mount of excess seam material. These actions eliminate the accumulation of excess seam material at the hinge ends and thereby eliminate the protuberances.

Figure 16:
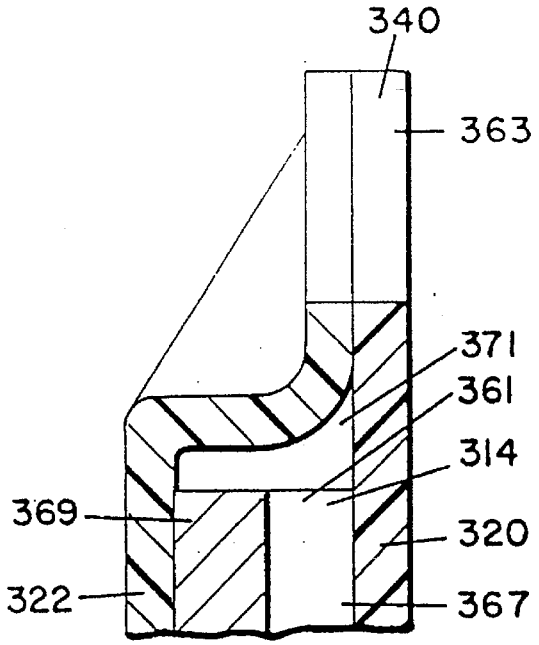

The details of seam notch 363 and insert notch 359 are shown in FIG. 16. The other seam notch-insert notch pairs are substantially identical. The cross-sectional view in FIG. 16, taken along line XVI—XVI of FIG. 15, cuts through seam notch 363, insert notch 371, and hinge 312. The spine 314, the insert notch 371 in the insert 367, and the hinge web 369, can be seen sealed between the polymeric sheet 320 and 322.

There is a second embodiment of the end-of-the-hinge notch concept which is described above as the first embodiment of that concept. The second embodiment of the notch concept is appropriate when it is desired to minimize the protuberance problem described in the first embodiment of the notch concept, but when the placement of a notch in the peripheral seam of the polymeric sheets, at the hinge ends, is not acceptable.

The protuberance problem can be very significantly reduced if an insert notch is provided at each of the four hinge ends of the insert, even if the seam notches are not formed in the peripheral seam of the polymeric sheets.

Figure 17:
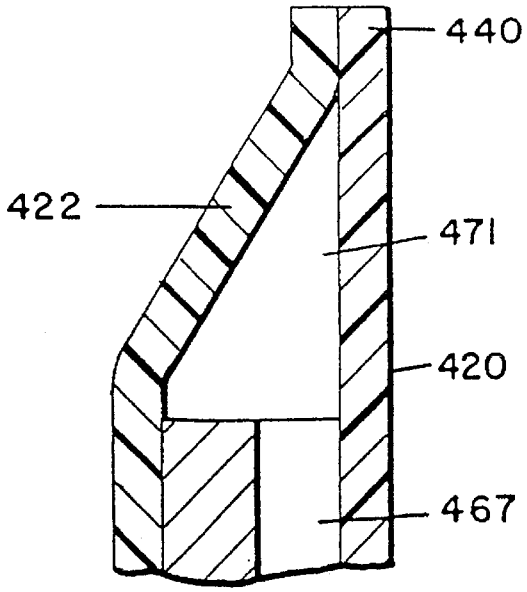
Figure 18:
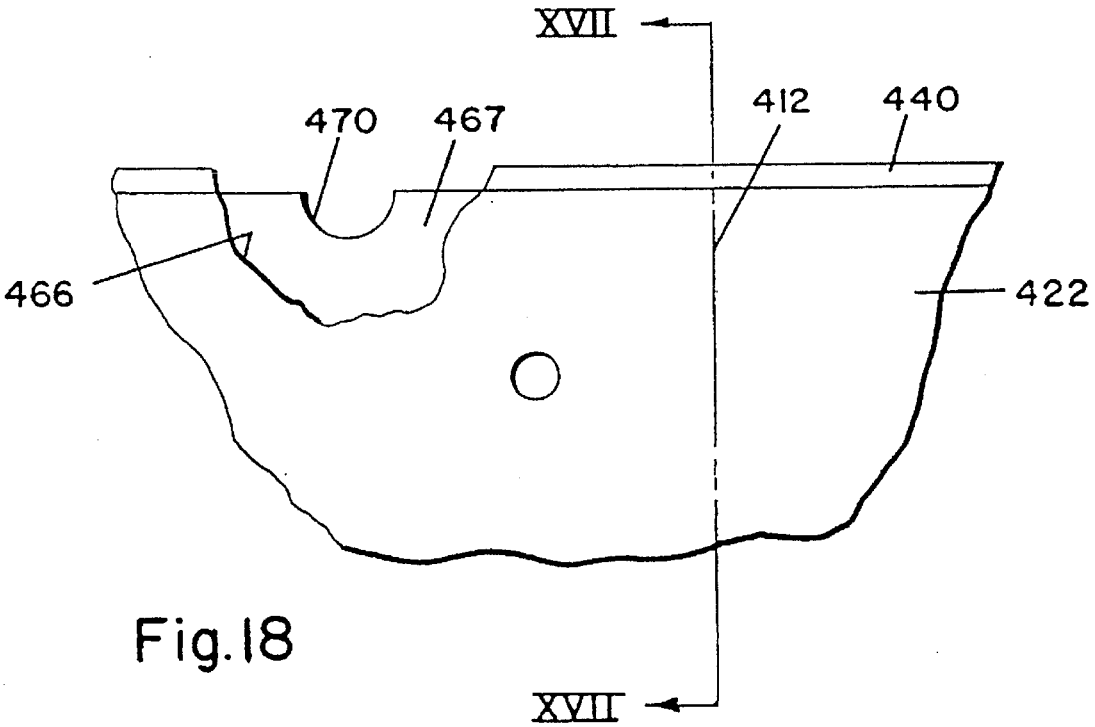

This second embodiment of the notch concept is shown in FIG. 17 and 18. Referring to FIG. 18, the insert 467 has an insert notch at each of the four hinge ends. Notch 470 is visible in FIG. 18, because of cut way 466. Notch 471 is not visible in FIG. 18, because it is within the polymeric sheets 420 (not visible) and 422. The outer notches are not within the bounds of FIG; 18, but are simply duplicates of the notch shown. Cross-sectional view line XVII—XVII cuts through notch 471. The seam 440 carries straight across the top of hinge 412, even where there is an insert notch 471 beneath the polymeric sheet 422 at the top of hinge 412.

FIG. 17 is a cross-sectional view of the embodiment shown in FIG. 18, taken along line XVII—XVII. FIG. 17 shows the notch 471 in stiffener 467. The notch 471 is at the upper end of hinge 412. The insert notch 471 and the entire stiffener 467 are encased between the polymeric sheets 420 and 422 which are sealed together at seam 440. Rather than following the curve of the notch, as occurs in the first embodiment of the notch concept, in the second embodiment of the notch concept, the seam 440 bridges across the mouth or diameter of each insert notch. When the binder is closed, the accumulation of excess seam material at the hinge ends is allowed to retract into and is enveloped by the adjacent insert notch. This eliminates the protuberances at the hinge ends.

There is a third embodiment of the end-of-the-hinge notch concept which is described above as the first and second embodiments of that concept. The third embodiment of the notch concept is appropriate when it is desired to minimize the protuberance problem described in the first embodiment of the notch concept, but the placement of the first embodiment's notches in the peripheral seam of the polymeric sheets is not acceptable, and the second embodiment does not sufficiently reduce the protuberance problem.

The protuberance problem can be very significantly reduced if an insert notch is provided at each hinge end of the insert, and a sealed web is formed inwardly from the peripheral seam of the polymeric sheets up to or into the mouth of each insert notch.

Figure 19:
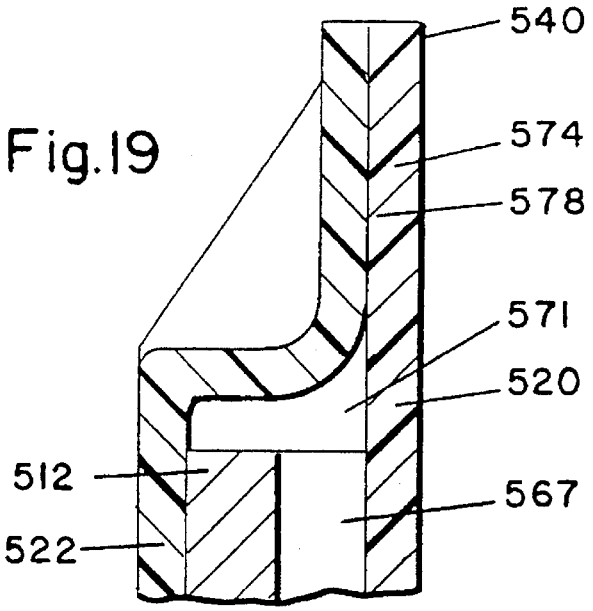
Figure 20:
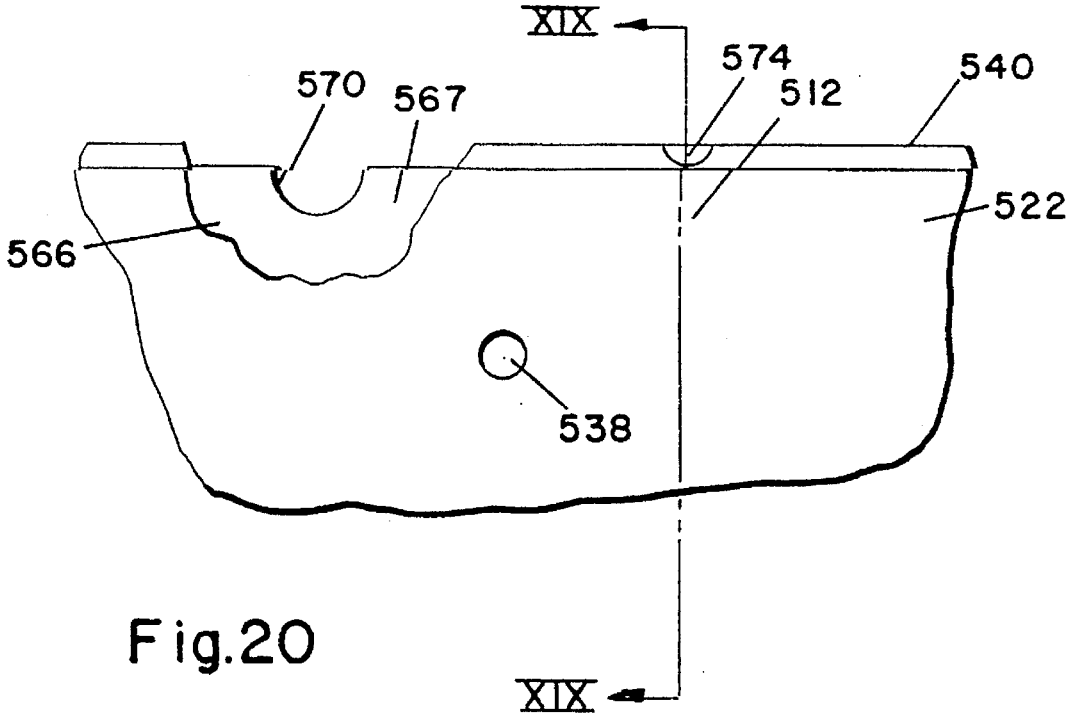

This third embodiment of the notch concept is shown in FIG. 19 and 20. The insert 567 has an insert at each of the four hinge ends. Notch 570 is visible in FIG. 20 because of cut way 566. Notch 571 is not visible in FIG. 20, because it is within the polymeric sheets 520 (not visible) and 522. The other notches are not within the bounds of FIG. 20, but are simply duplicates of the notch shown. Cross-sectional view line XIX—XIX cuts through notch 571. The seam 540 carries straight across the top of hinge 512, even where there is an insert notch 571 beneath the polymeric sheet 522 at the top of hinge 512.

FIG. 19 is a cross-sectional view of the embodiment shown in FIG. 20, taken along line XIX—XIX. FIG. 19 shows the notch 571 in stiffener 567. The notch 571 is at the upper end of hinge 512. The notch 571 and the entire stiffener 567 are encased between the polymeric sheets 520 and 522 which are sealed together at seam 540. Rather than following the curve of the notch, as occurs in the first embodiment of the notch concept or simply bridging the mouth of the insert notch, as occurs in the second embodiment of the notch concept, in the third embodiment of the notch concept, the seam 540 bridges across the mouth or diameter of each insert notch with an edge web 573. It should be understood that corresponding webs 573 and 575 are positioned at corresponding hinge ends.

The edge web 574 is formed by extending the peripheral edge bond, (for example, 540) between the polymeric sheet 522 and 520 inwardly toward the insert notches (for example, 571), in a semi-circular shape, to form an edge web bond (for example, 578). The normally very narrow peripheral seam 540 or bond becomes much wider at the critical hinge ends because of the presence of the edge webs (for example, 574), and edge web bonds (for example, 578). When the binder is closed, the accumulation of excess seam material at the hinge ends is allowed to retract into insert notch 571 and thereby eliminates the protuberance at the hinge end.

The result of employing the third embodiment is a more durable and more attractive product. The double thickness bonded edge web provides a reinforced corner which has high tensile strength not only parallel to the seam, but also perpendicular to the seam and plane of the open binder. The former prevents splitting of the hinge and the latter prevents opening of the seam at the hinge end. The edge web also provides abrasion resistant at the hinge end to prevent wear damage.

Another feature which can be incorporated into the ring binder concept of this invention is the idea of a curvable spine. The curvable spine idea involves providing one or more hinge-like spine grooves on the inside surface of the spine potion of the insert between the two hinge grooves. This allows the spine to flatten when the covers are open, but to curve about the longitudinal axis of the spine (concave on the inside and convex on the outside) when the covers are closed. The design reduces the angular displacement of the hinges from the open to the closed position and therefore reduces the wear and increases the useful life of the hinges and binder. Just as importantly, however, the resulting binder has a very attractive look.

When bound books are prepared at the highest level of the book binder's art, the resulting books typically have a distinctive curved-spine look when closed. This curved-spine look is so visibly characteristic of fine bookbinding that it has come to convey a sense of quality and desirability in books. It has been found that a seemingly simple extension of the insert-hinge-groove concept of the present invention can result in a ring binder having the curved-spine look of fine case-method book binding.

Figure 21:
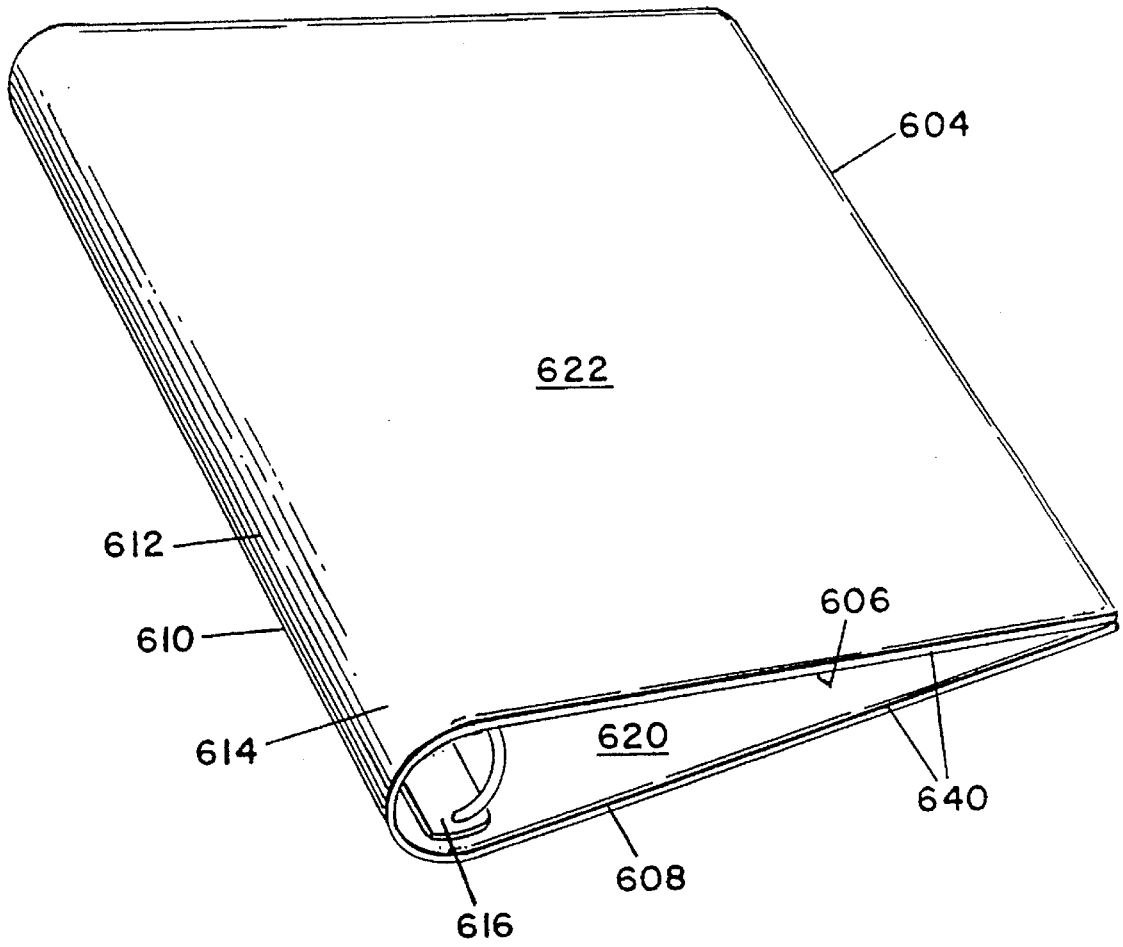

Referring to FIG. 21, and comparing it to FIG. 1, the binder 604 in FIG. 21 is shown to have front and back cover panels 606 and 608, respectively. The two cover panels are hinged along Transverse hinge lines 610 and 612 to a back panel or spine potion of the binder, as indicated generally by the numeral 614. A conventional ring binder mechanism 616 is affixed to the inner surface of the binder, preferably on the back cover panel 608, adjacent the spine 614.

Figure 23:
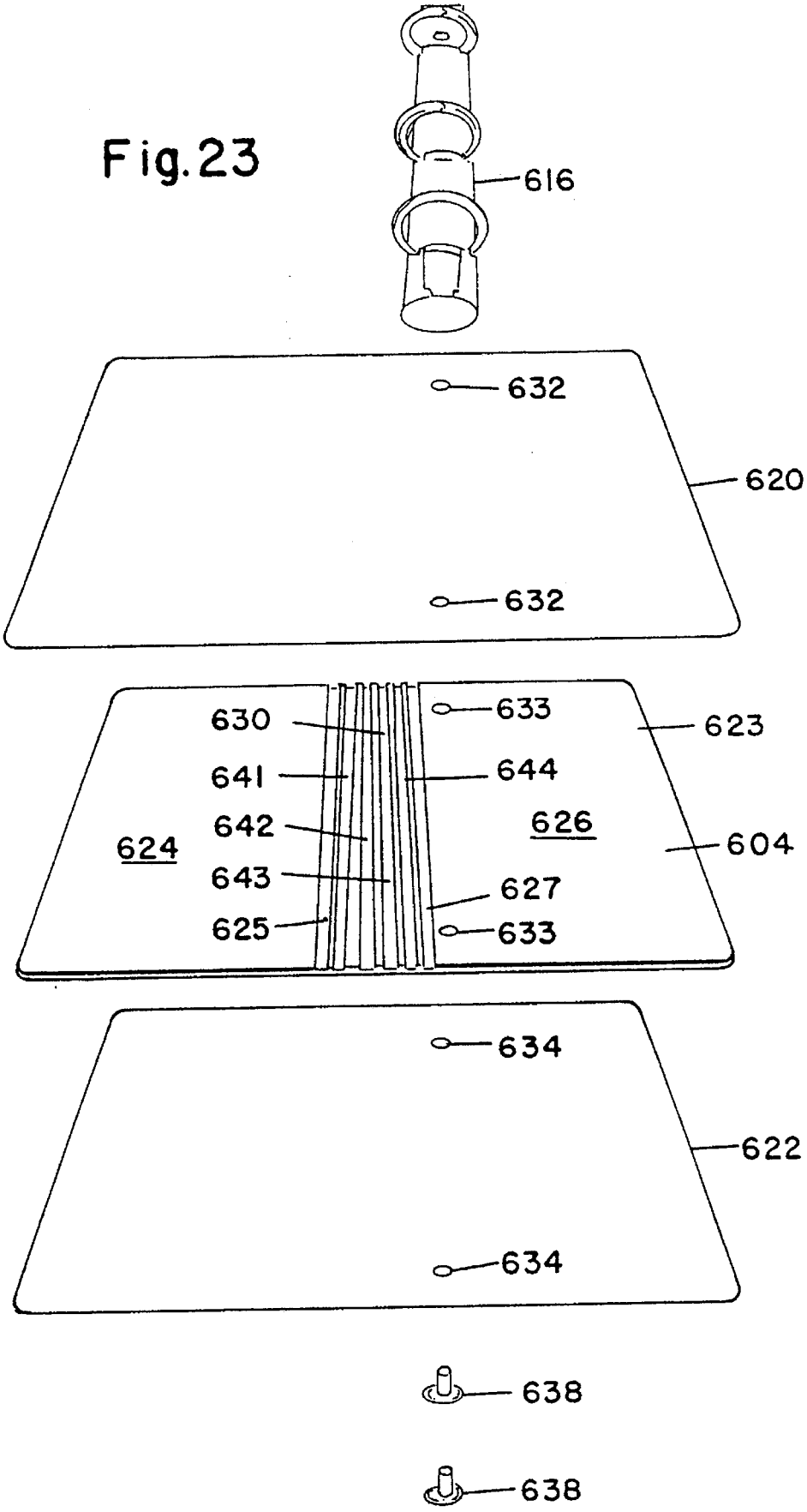

As in the other embodiments of the present invention and as best shown in the exploded view of FIG. 23, the binder 604 is composed of two rectangular polymeric sheets 620 and 622. The sheets are of sufficient size to form the entire inner and outer covering of the binder 604. Disposed between sheets 620 and 622 is a semirigid rectangular insert 623. The insert 623 is formed or machined with two parallel hinge grooves 625 and 627 which divide the insert into three zones. Front zone 624 and back zone 626 are dimensioned to be approximately the same length and width as the cover panels of the binder 604. Spine zone 630 is dimensioned to be approximately the same length and width as the spine 614.

Figure 24:
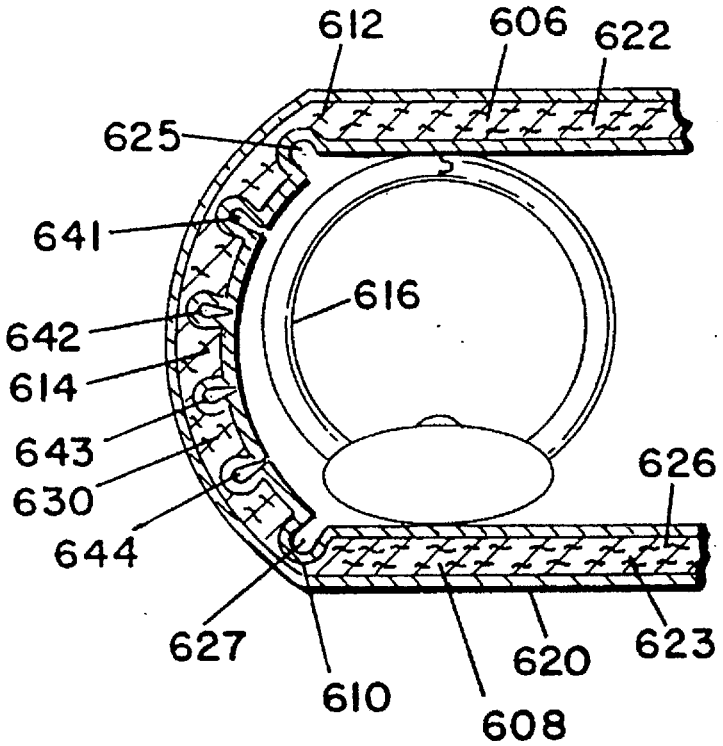

The primary unique aspect of this embodiment is the provision of spine grooves between the hinge grooves 625 and 627. These spine grooves act like the hinge grooves and allow the spine 614 to transform from a flat configuration to a curved configuration in which the inner surface of the spine is concave about the longitudinal axis of the spine 614. The spine grooves are spaced on 1 to 2 cm. centers between the hinge grooves. Thus, in a typical 4.5 cm.-diameter-ring binder, as shown in FIGS. 21, 22, 23, and 24, the hinge grooves would be spaced on 6 cm. centers and four spine grooves (641, 642, 643 and 644) would be evenly spaced on 1.2 cm. centers between the hinge grooves. The spacing and number of spine grooves is selected to result in a smooth curve on the outside surface of the spine when the binder is closed, as shown in FIGS. 21 and 24. FIG. 24 shows a spine with a pronounced curve about the longitudinal axis of the spine, when the binder is closed.

It should be noted that, in the preferred embodiment of this curvable-spine concept, the ring hardware 616 is mounted, by conventional rivets 638 and holes 632, 633 and 634, to one or the other of the covers 606 or 608 rather than to the spine area. Although the spine area can be used, attachment to one of the covers, preferably the back cover 608, gives far superior results. This is because the spine curves smoothly around one side of the rings.

Figure 22:
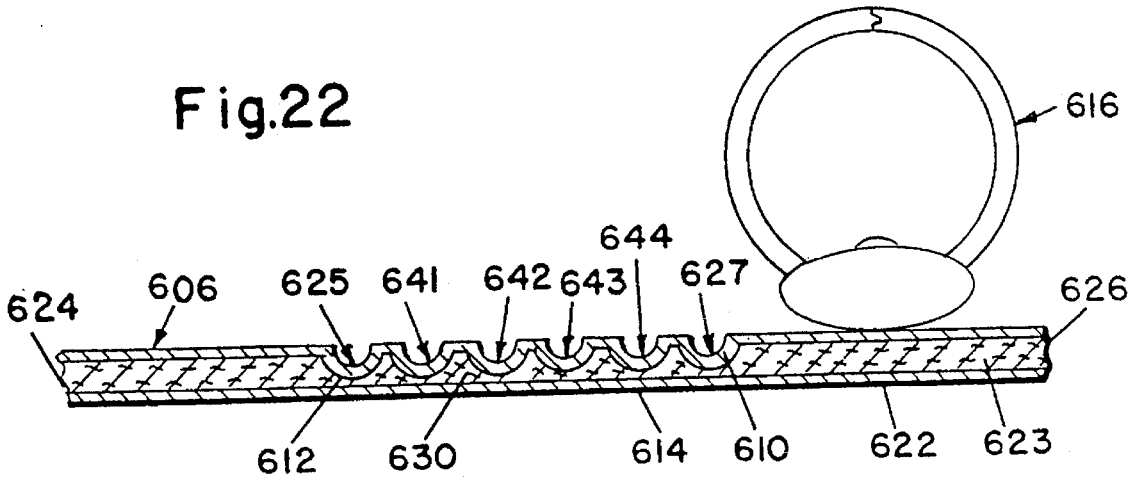
Figure 25:
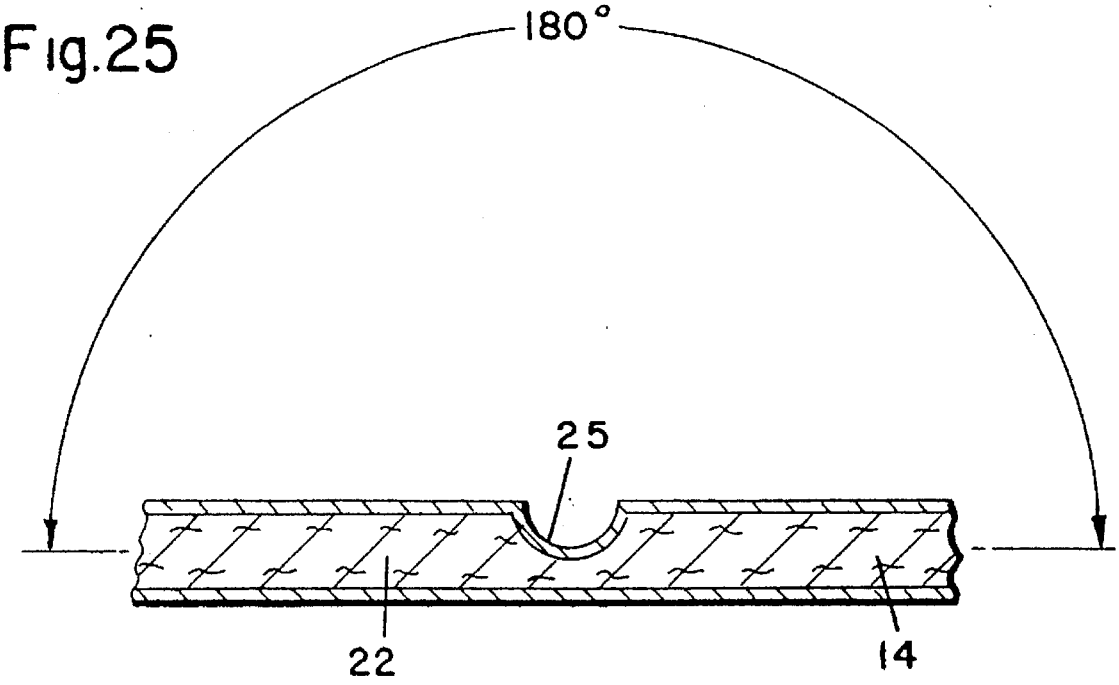
Figure 26:
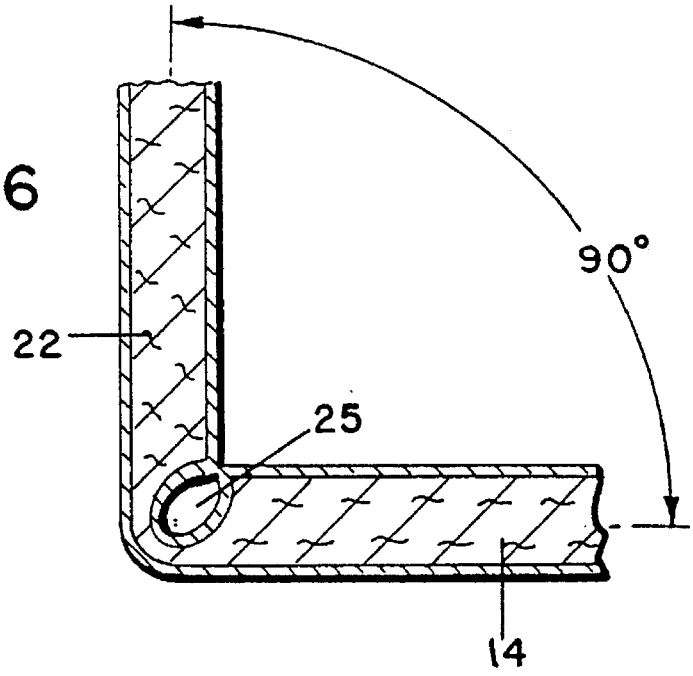
Figure 27:
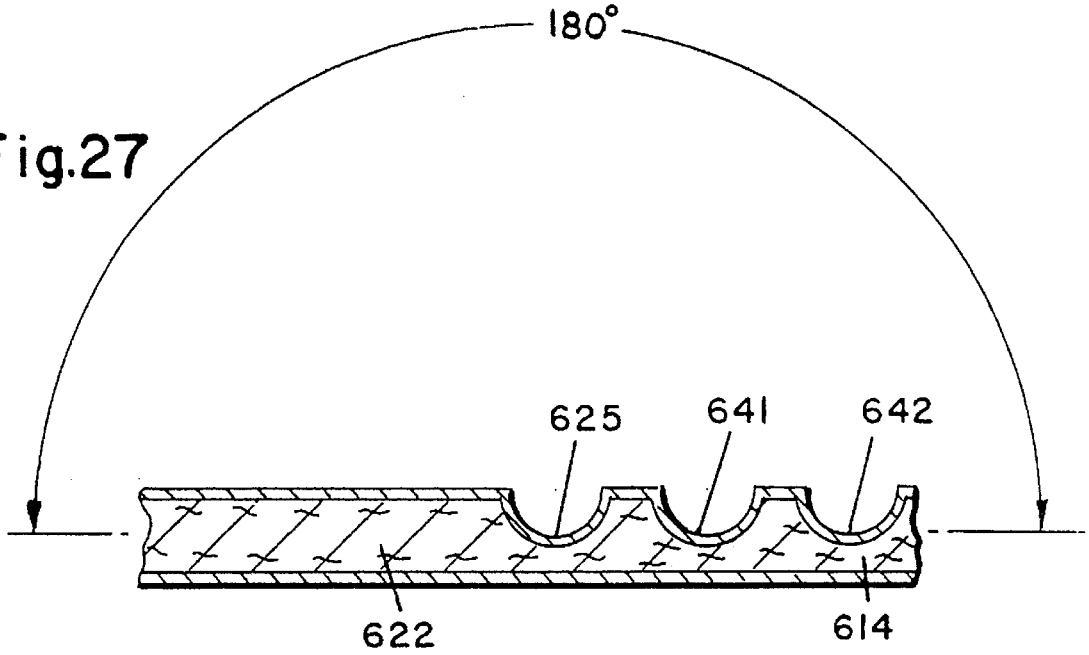
Figure 28:
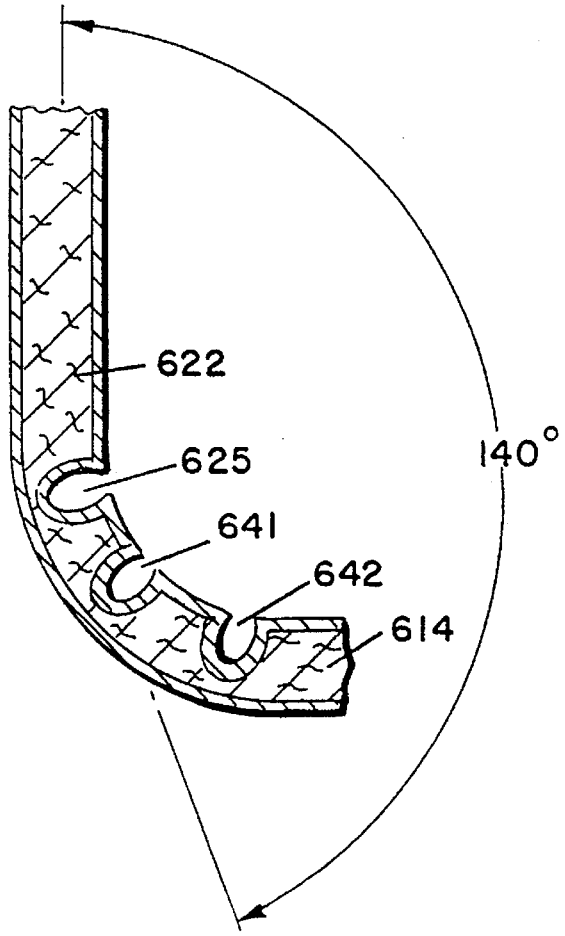

FIGS. 22 and 24 present sectional views along the longitudinal axis of the spine. FIG. 22 shows the binder 604 open and FIG. 24 shows the binder 604 closed. In these views, the binge grooves 625 and 627 separate the front cover 606 from the spine 614, and separate the rear cover 608 from the spine 614. The ring hardware 616 is mounted on the rear cover 608 adjacent the hinge groove 627. FIG. 24 rather clearly shows that the angle formed between each of the covers 606 and 608 and the curved spree 614, when the binder is closed, is larger than is the case when a flat spine is employed. This larger closed angle reduces the range of angle between the open (180 degrees) (see FIG. 27) to closed (approximately 140 degrees) (see FIG. 28) position. A flat-spined binder has an open position of 180 degrees (see FIG. 25) and a closed angle of 80 to 90 degrees (see FIG. 26).

Although for clarity, FIGS. 22 through 24 do not show the hinge notches which have been described above in connection with other embodiments, it should be understood that this embodiment could include those hinge notches at the ends of the hinge grooves and/or the spine grooves.

It is obvious that minor changes may be made in the form and construction of the invention without departing from the material spirit thereof. It is not, however, desired to confine the invention to the exact form herein shown and described, but it is desired to include all such as properly come within the scope claimed.

Having thus disclosed this invention, what is claimed is:

1. A ring binder comprising:

(a) an insert, said insert having a pair of parallel flexible webs spaced apart a predetermined distance to divide said insert into three zones, hingedly connected by said pair of parallel flexible webs, said zones being dimensioned to define a front cover panel, a back cover panel and a spine panel, each of said webs having a first end and a second end, and an insert notch at each end, (b) a matching pair of thermoplastic, heat-sealable sheets disposed on opposite sides of said insert and heat-sealed together only about their peripheral edges, and (c) a ring mechanism fixed to said spine panel.

2. The ring binder as recited in claim 1, wherein the peripheral edges of the thermoplastic, heat-sealable sheets have seam notches adjacent each insert notch.

3. The ring binder as recited in claim 1, wherein the peripheral edges of the thermoplastic, heat-sealable sheets have seam webs which extend inward from the peripheral edges and are adjacent each insert notch.

4. The ring binder as set forth in claim 1, wherein said insert comprises a sheet of fiber board milled with two grooves.

5. The ring binder as set forth in claim 1, wherein said insert comprises three separate boards attached to a flexible backing.

6. The ring binder as set forth in claim 1, wherein said insert comprises a center plate and a pair of end plates, the center plate and one of the end plates being interconnected by a first flexible tape, and the center plate and the other of the end plates being interconnected by a second flexible tape.

7. The ring binder as set forth in claim 1, wherein one of said matching pair of thermoplastic, heat-sealable sheets is adhesively bonded to the insert.

8. The ring binder as set forth in claim 1, wherein both of said matching pair of thermoplastic, heat sealable sheets are adhesively bonded to the insert.

9. The ring binder as set forth in claim 1, wherein the peripheral edges of said matching pair of thermoplastic, heat-sealable sheets are sealed with a single minimal seam.

10. A ring binder comprising:

(a) an said insert having a pair of parallel flexible hinge webs spaced apart a predetermined distance to divide said insert into three zones, hingedly connected by said pair of parallel flexible webs, said zones being dimensioned to define a front cover panel, a back cover panel and a spine panel, and having at least one flexible spine web parallel to and spaced between said hinge webs, wherein at least one of said parallel flexible hinge webs has an insert notch, (b) a matching pair of thermoplastic, heat-sealable sheets disposed on opposite sides of said insert and heat-sealed together only about their peripheral edges, and (c) a ring mechanism fixed to one of said front cover panel and said back cover panel near the spine thereof, (d) whereby said hinge webs, said spine webs and the unsealed portions of said thermoplastic, heat-sealable sheets disposed on opposite sides of said hinge and spine webs form flexible hinges, enabling the spine to fold conformingly about the ring mechanism when the binder is closed.

* * * * *